US007377823B2

(12) United States Patent
Chen

(10) Patent No.: US 7,377,823 B2
(45) Date of Patent: May 27, 2008

(54) PRESS-FIT PIN

(75) Inventor: Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 22 days.

(21) Appl. No.: 11/134,889

(22) Filed: May 23, 2005

(65) Prior Publication Data

US 2006/0264076 A1 Nov. 23, 2006

(51) Int. Cl.
*H01R 13/42* (2006.01)

(52) U.S. Cl. ..... 439/751; 439/82

(58) Field of Classification Search ..... 439/751
See application file for complete search history.

(56) References Cited

U.S. PATENT DOCUMENTS 2,006,813 A * 7/1935 Powers ..... 411/352
3,252,204 A * 5/1966 McFaddan ..... 29/843
3,255,430 A 6/1966 Phillips
3,319,217 A 5/1967 Phillips
3,717,841 A 2/1973 Mancini
3,792,412 A * 2/1974 Madden ..... 439/82
3,846,741 A 11/1974 Kunkle et al.
4,097,101 A * 6/1978 Holt et al. ..... 439/82
4,175,810 A * 11/1979 Holt et al. ..... 439/82
4,186,982 A 2/1980 Cobaugh et al.
4,230,384 A 10/1980 Anhalt
4,386,806 A * 6/1983 Axen et al. ..... 299/5
4,469,394 A * 9/1984 Verhoeven ..... 439/873
4,526,429 A * 7/1985 Kirkman ..... 439/82
4,557,539 A 12/1985 Zust et al.
4,586,778 A * 5/1986 Walter et al. ..... 439/825
4,606,589 A 8/1986 Elsbree, Jr. et al.
4,698,026 A * 10/1987 Rolf ..... 439/82
4,728,164 A * 3/1988 Lemmens et al. ..... 439/870

(Continued)

FOREIGN PATENT DOCUMENTS

DE 2742716 A 4/1979

(Continued)

OTHER PUBLICATIONS

The Press Fit Contact Technology for Automotive Applications as published in Shin-Kobe Technical Report No. 14 (Feb. 2004) (6 pages).

(Continued)

*Primary Examiner*—Briggitte Hammond
*Assistant Examiner*—Larisa Tsukerman
(74) *Attorney, Agent, or Firm*—Osha Liang LLP

(57) ABSTRACT

A press-fit pin is press-fitted into a conductive through-hole disposed on a printed circuit board. The press-fit pin includes a contact portion, a shoulder portion, a press-fit portion, and a tip portion. The contact portion forms a terminal of a male connector to be mounted on the printed circuit board by inserting into a housing of the male connector along with the shoulder portion. The press-fit portion includes a interference fit mechanism that comprises a complementary protrusion and recess. The press-fit portion has the property of elastic deformation. Thus, the interference fit mechanism comes into interference with the through-hole, thereby allowing the press-fit pin to be mechanically fixed to the printed circuit board.

6 Claims, 9 Drawing Sheets

U.S. PATENT DOCUMENTS

| | | | | | |
|---|---|---|---|---|---|
| 4,746,301 | A | | 5/1988 | Key | |
| 4,759,721 | A | | 7/1988 | Moore et al. | |
| 4,769,907 | A | * | 9/1988 | Sebastien | 29/874 |
| 4,854,900 | A | | 8/1989 | Muhlhoff | |
| 4,857,018 | A | | 8/1989 | Pickles | |
| 4,857,019 | A | | 8/1989 | Brubaker et al. | |
| 4,867,710 | A | | 9/1989 | Harting et al. | |
| 4,878,861 | A | * | 11/1989 | Kendall et al. | 439/751 |
| 4,889,496 | A | | 12/1989 | Neidich | |
| 4,936,797 | A | * | 6/1990 | Wehrle et al. | 439/751 |
| 4,954,103 | A | * | 9/1990 | Liebich et al. | 439/751 |
| 5,051,108 | A | | 9/1991 | Lincoln | |
| 5,073,119 | A | * | 12/1991 | Soes | 439/82 |
| 5,131,872 | A | | 7/1992 | Consoli et al. | |
| 5,184,400 | A | * | 2/1993 | Cray et al. | 29/879 |
| 5,195,237 | A | | 3/1993 | Cray et al. | |
| 5,487,684 | A | * | 1/1996 | Schalk et al. | 439/751 |
| 5,497,546 | A | * | 3/1996 | Kubo et al. | 29/843 |
| 5,564,954 | A | * | 10/1996 | Wurster | 439/751 |
| 5,567,183 | A | * | 10/1996 | Sano | 439/751 |
| 5,573,431 | A | * | 11/1996 | Wurster | 439/751 |
| 5,667,412 | A | | 9/1997 | Takahashi et al. | |
| 5,738,550 | A | * | 4/1998 | Sakuraoka et al. | 439/751 |
| 5,897,401 | A | * | 4/1999 | Fili et al. | 439/733.1 |
| 6,077,128 | A | | 6/2000 | Maag et al. | |
| 6,139,373 | A | * | 10/2000 | Ward et al. | 439/733.1 |
| 6,206,735 | B1 | * | 3/2001 | Zanolli | 439/736 |
| 6,217,346 | B1 | * | 4/2001 | Cubon | 439/78 |
| 6,305,949 | B1 | | 10/2001 | Okuyama et al. | |
| 6,443,768 | B1 | * | 9/2002 | Dirkers et al. | 439/607 |
| 6,722,928 | B1 | | 4/2004 | Noda et al. | |
| 6,866,523 | B2 | * | 3/2005 | Yamashita | 439/79 |
| 6,945,827 | B2 | | 9/2005 | Grube et al. | |
| 7,048,594 | B2 | * | 5/2006 | Tsuchiya | 439/751 |
| 2003/0236009 | A1 | | 12/2003 | Tsuchiya | |
| 2004/0242082 | A1 | | 12/2004 | Tsuchiya | |
| 2004/0259428 | A1 | * | 12/2004 | Bleicher | 439/733.1 |
| 2005/0093559 | A1 | | 5/2005 | Mori et al. | |
| 2006/0035535 | A1 | * | 2/2006 | Kawahara et al. | 439/751 |
| 2007/0010139 | A1 | * | 1/2007 | Chen | 439/751 |
| 2007/0093143 | A1 | * | 4/2007 | Nomura | 439/751 |

FOREIGN PATENT DOCUMENTS

| | | |
|---|---|---|
| DE | 19952934 | 5/2000 |
| DE | 102 29 331 | 1/2004 |
| EP | 0 023 296 A | 2/1981 |
| EP | 0 105 044 | 4/1984 |
| EP | 0 392 549 | 10/1990 |
| GB | 147 007 | 4/1921 |
| JP | 60-258875 | 12/1985 |

OTHER PUBLICATIONS

Notification of Transmittal of International Search Report and Written Opinion, International Search Report, and Written Opinion of the International Searching Authority for International Application PCT/US2006/005465 mailed Aug. 10, 2006 (12 pages).

International Application No. PCT/US2006/012376; International Search Report dated Aug. 4, 2006 (7 pages).

Notification of Transmittal of the International Preliminary Report on Patentability dated Jul. 26, 2007 in PCT/US2006/005465, and the International Report on Patentability, 6 pages.

* cited by examiner

PRESS-FIT PIN

BACKGROUND OF INVENTION

1. Field of the Invention

The invention relates generally to a press-fit pin, which is press-fitted into a through-hole disposed on a printed circuit board.

2. Background Art

In recent years, increasing awareness of environmental issues has focused attention on a junction technique using a press-fit pin or compliant pin as alternative to the soldering junction technique using lead material.

The press-fit pin junction technique is to mechanically fix a press-fit pin or compliant pin, which is an acicular terminal given the property of compressive elasticity, onto a printed circuit board by way of inserting the press-fit pin into a through-hole, whose diameter is slightly smaller than the width of the press-fit pin, of the printed circuit board, thereby ensuring a frictional force. A component such as a male connector is attached to the press-fit pin disposed on the print circuit board, thereby allowing lead-free mechanical and electrical interconnection.

The press-fit pin includes a press-fit portion to be in pressure contact with an internal surface of the through-hole of the printed circuit board. The press-fit portion may be manufactured by stamping out a pin-like shape from a metal plate and thereafter forming a slit (needle eye) at a center of the resulting pin along a longitudinal direction.

Securing a sufficient effective contact area and maintaining an adequate contact pressure are necessary for assuring fundamental performance in reliability of connection of the press-fit pin. For example, if the contact pressure is too small, the effective contact area is insufficient, resulting in deterioration in the reliability of the connection. In contrast, in a case where the contact pressure increases by using a press-fit pin in a larger size and shape in order to obtain higher contact pressure, a portion of the printed circuit board may be cracked due to improper insertion force. In addition, the press-fit pin may be damaged. This may cause an increase in electrical contact resistance.

SUMMARY OF INVENTION

A press-fit pin is press-fitted into a conductive through-hole disposed on a substrate such as a printed circuit board. The press-fit pin includes a contact portion, a shoulder portion, a press-fit portion, and a tip portion. The contact portion forms a terminal of a male connector to be mounted on the printed circuit board by inserting into a housing of the male connector along with the shoulder portion. The press-fit portion includes a interference fit mechanism that comprises a complementary protrusion and recess. The press-fit portion has the property of elastic deformation. Thus, the interference fit mechanism comes into interference with the through-hole, thereby allowing the press-fit pin to be mechanically fixed to the printed circuit board.

Other aspects and advantages of the invention will be apparent from the following description and the appended claims.

DETAILED DESCRIPTION

Figure 1:
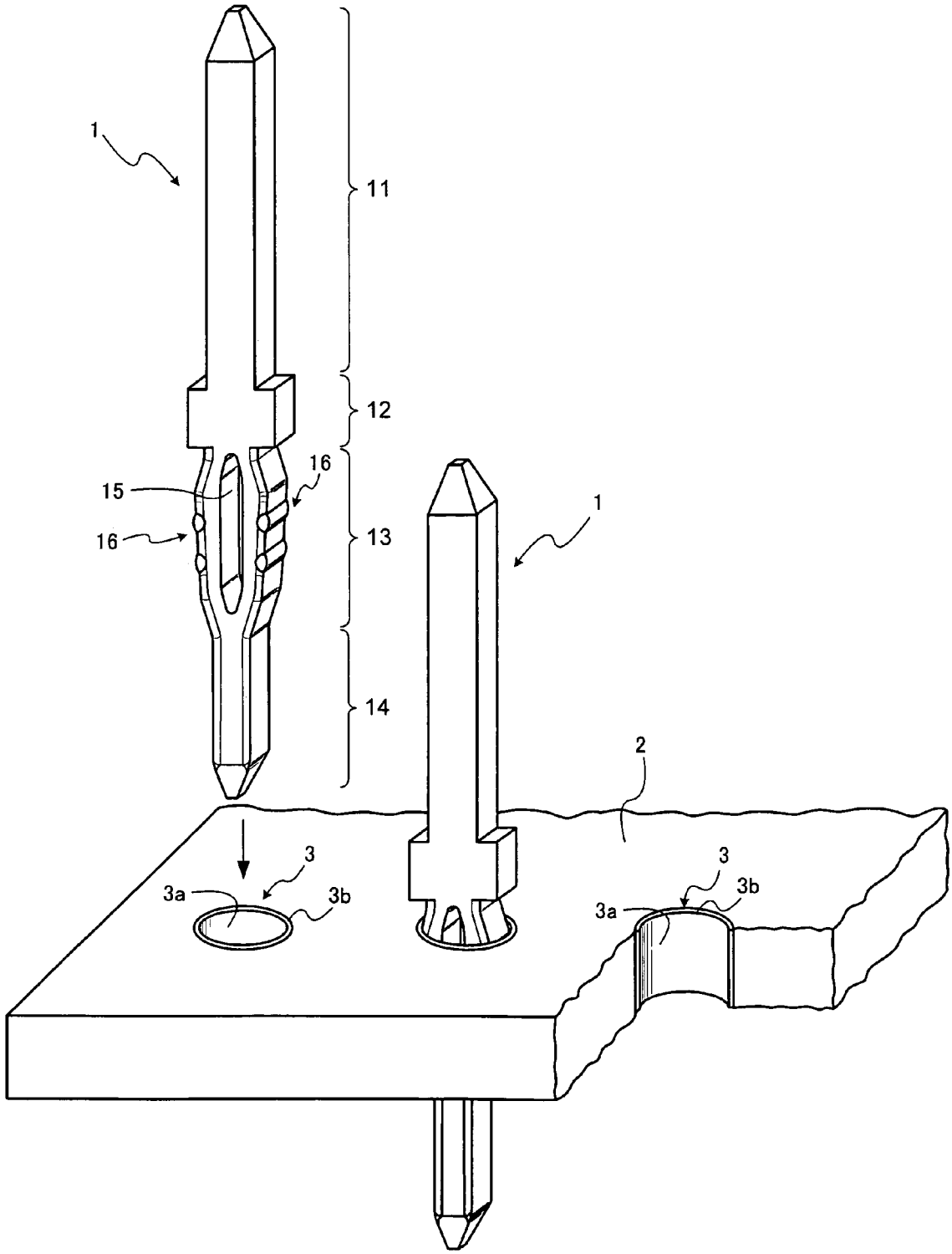
FIG. 1 shows a perspective of a press-fit pin according to one embodiment of the invention as the press-fit pin 1 is being inserted into a printed circuit board.

FIG. 1 shows a perspective of a press-fit pin according to one embodiment of the invention as the press-fit pin 1 is being inserted into a substrate such as a printed circuit board. As shown in FIG. 1, a press-fit pin 1 is press-fitted into a through-hole 3 formed on a printed circuit board 2. An inner surface 3*a* of the through-hole 3 is plated, and an opening 3*b* of the through-hole 3 forms a part of a profile of a circuit pattern (not shown). The press-fit pin 1 that is press-fitted into the printed circuit board 2 mechanically fixes a male connector thereto (not shown), forming a terminal of the male connector. The male connector mounted on the printed circuit board 2 is configured to connect to a female connector, and thereby terminals of both connectors are electrically interconnected.

The press-fit pin 1 may be manufactured by stamping out a predetermined-shaped pin from a metallic plate made of, for example, copper alloy, and pressing the stamped pin. The press-fit pin 1 may alternatively be formed using other known materials and methods. The press-fit pin 1 typically includes a contact portion 11, a shoulder portion 12, a press fit portion 13, and a tip portion 14. Dimensions of the press-fit pin 1 are determined to a large extent by a size and shape of the printed circuit board 2 and components, such as connectors, applied to the printed circuit board 2.

The contact portion 11 forms a terminal of the male connector as a final product by being inserted along with the shoulder portion 12 into a housing of the male connector that will be mounted on the printed circuit board 2. Thus, the contact portion 11 can electrically be in contact with a terminal of the mating connector, i.e., the female connector. The shoulder portion 12 fits into a receiving portion (not shown) disposed within the male connector, thereby allowing the male connector to be mechanically fixed. The press fit portion 13 extends downward from a lower portion of the shoulder portion 12. The press fit portion 13 comes in frictional contact with the inner surface 3*a* of the through-hole 3, allowing the press-fit pin 1 itself to be fixed. To this end, the press fit portion 13 is configured to be elastically deformable, and the dimensions of the press fit portion 13 are selected to be slightly larger than a diameter of the through-hole 3. In this embodiment, a slit (a needle eye) 15 is formed on a portion to be the press fit portion 13 in a longitudinal direction, and the portion having the slit 15 is expanded outward, causing the press fit portion 13 to be elastically deformable in the traverse direction. A surface of the press fit portion 13 includes an interference fit mechanism 16. The interference fit mechanism 16 is composed of one or more tiny protrusions and/or recesses, as will be described below. The interference fit mechanism 16 allows the effective contact area with the inner surface 3*a* of the through-hole 3 to be increased, increasing a friction force, due to press-fitting the press-fit pin 1 into the through-hole 3. The tip portion 14 is disposed at a lower portion of the press fit portion 13. The tip portion 14 serves as a positioning and setting mechanism during the process of press-fitting into the through-hole 3.

Figure 2:
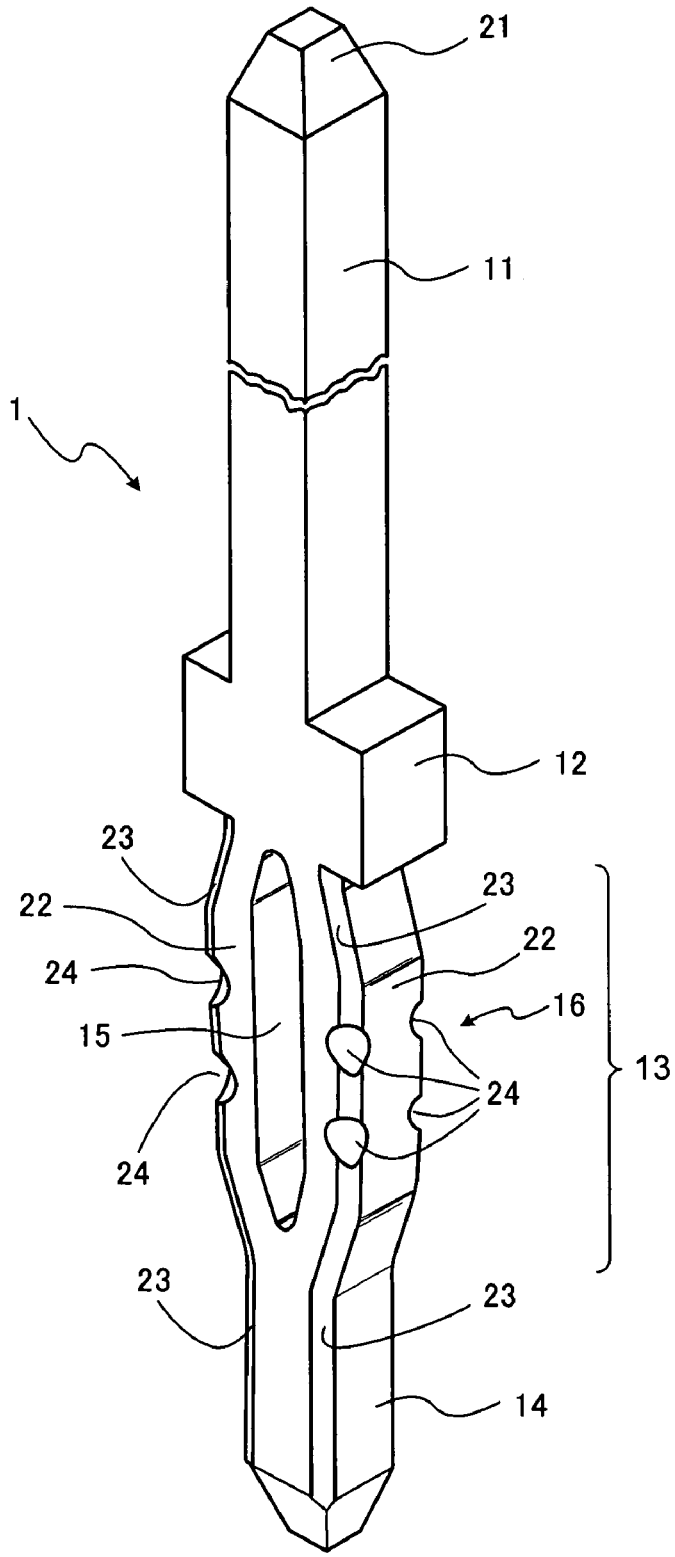
FIG. 2 shows a perspective view of a press-fit pin according to one embodiment of the invention.
Figure 3:
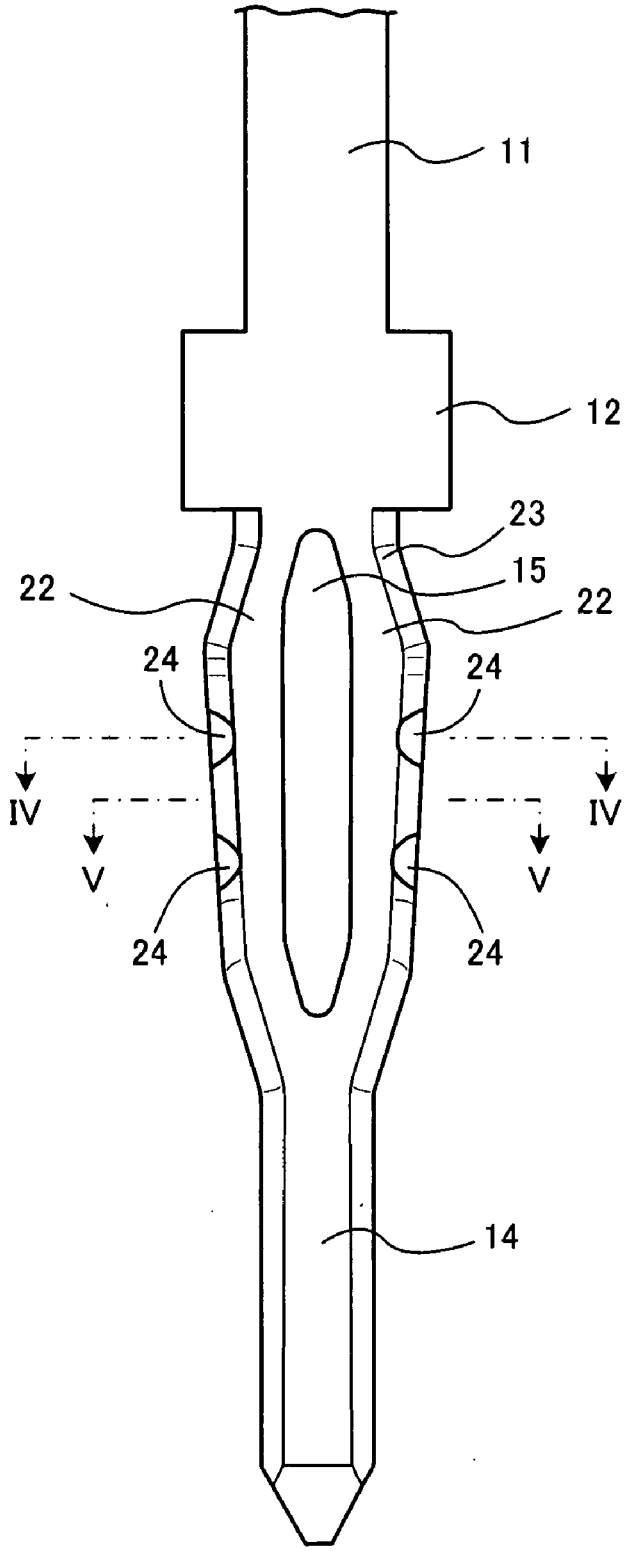
FIG. 3 shows a partially front view of the press-fit pin shown in FIG. 2.

FIGS. 2 and 3 show a press-fit pin 1 in detail according to an embodiment of the invention. The press-fit pin 1 in this embodiment includes an interference fit mechanism 16 comprising the recesses 24. Referring to FIG. 2, the contact portion 11 includes a tapered portion 21 at a distal end thereof. The shoulder portion 12 is disposed at the proximate end of the contact portion 11. The shoulder portion 12 is formed in a rectangular shape in cross section against other shapes. The shoulder portion 12 extends outward beyond the width of the press fit portion 13. The shoulder portion 12 prevents the press-fit pin 1 from passing through the through-hole 3 of the printed circuit board 2, engaging with the opening 3*b* of the through-hole 3, even if an excessive insertion force is applied to the press-fit pin 1.

The press fit portion 13 frictionally contacts with the inner surface 3*a* of the through-hole 3 by pressure contact in accordance with elastic deformation thereof. The press fit portion 13 comprises two arm portions 22, which define the needle eye 15. Specifically, the arm portions 22 branching off from the shoulder portion 12 extend and merge together, being connected to the tip portion 14. By this configuration, the press fit portion 13 can elastically be deformed in a transverse direction substantially perpendicular to the longitudinal axis of the press-fit pin 1. A lower portion of the press-fit portion 13 may be configured in a tapered shape in order to reduce excessive interference with the through-hole 3 at an early stage of the insertion process.

The interference fit mechanism 16 is designed on a surface of the press fit portion 13. As described above, the interference fit mechanism 16 in this embodiment is composed of a plurality of recesses 24. Specifically, two recesses 24 are designed each on four outer edge portions or corners 23 formed on the arm portions 22 of the press fit portion 13. The outer edge portions 23 may be chamfered or rounded. It is believed that the recesses 24 allow an effective contact area with the inner surface 3*a* to be increased when the press-fit pin 1 is press-fitted into the through-hole 3, increasing friction force. The recesses 24 may tolerate margin errors between the press fit portion 13 and the through-hole 3.

Figure 4:
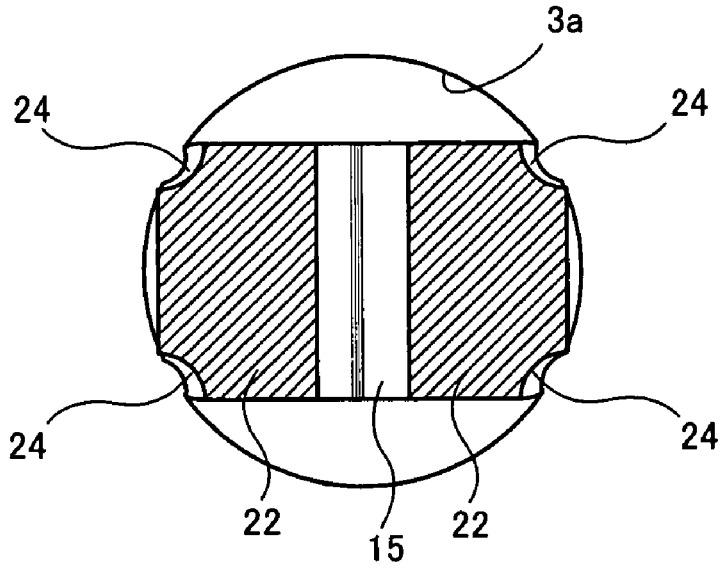
FIG. 4 shows a cross-sectional view of the press-fit pin along the IV-IV line shown in FIG. 3
Figure 5:
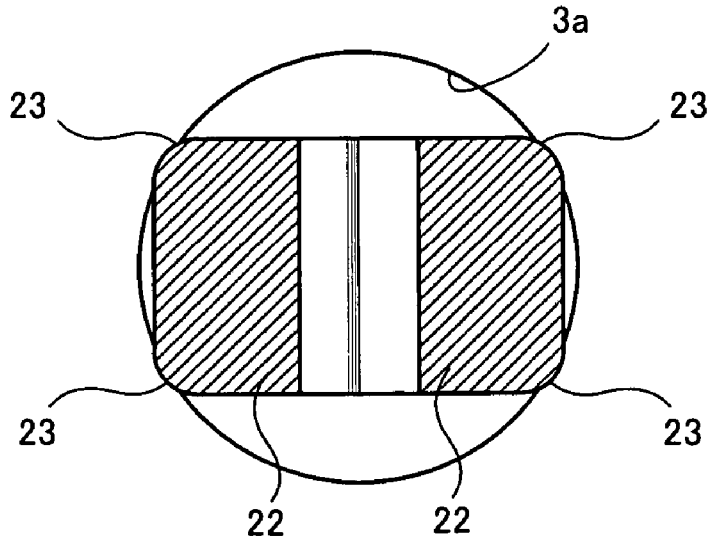
FIG. 5 shows a cross-sectional view of the press-fit pin along the V-V line shown in FIG. 3.
Figure 6:
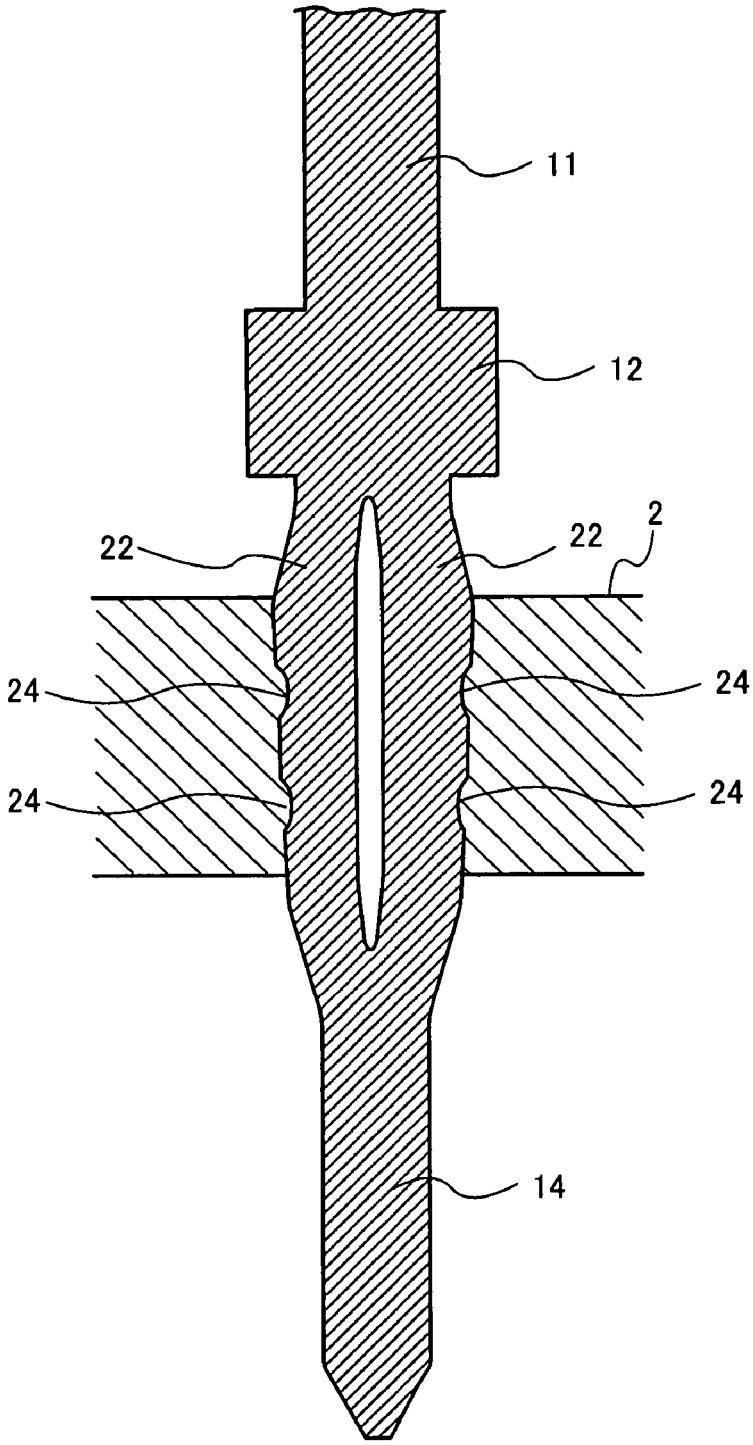
FIG. 6 shows a longitudinal cross-sectional view of the press-fit pin inserted into the present invention.

FIGS. 4 and 5 show a transverse cross-sectional view of the press-fit pin 1 as the press-fit pin 1 is press-fitted into the through-hole 3. Specifically, FIG. 4 shows a cross-sectional view of the press-fit pin 1 along the line IV-IV shown in FIG. 3 as including some of the recesses 24, and FIG. 5 shows a cross sectional view of the press-fit pin 1 along the line V-V shown in FIG. 3. Further, FIG. 6 shows a longitudinal cross-sectional view of the press-fit pin 1 as the press-fit pin 1 is press-fitted into the through-hole 3.

As shown in these figures, press-fitting of the press-fit pin 1 causes the inner surface 3*a* to be deformed so as to conform to serration of interference fit mechanism 16 due to interference with the interference fit mechanism 16. More specifically, as shown in FIGS. 4 and 6, when the press-fit pin 1 is inserted into the through-hole 3, the edge portions 23 of the press fit portion 13 come into interference with the inner surface 3*a* of the through-hole 3, and thereby the corresponding portions of the inner surface 3*a* is slightly pushed out radially-outwardly. Thereafter, portions of the inner surface 3*a* corresponding to the recesses 24 can be restored because of regionally elastic recovery. As a consequence, mechanical resistance to the insertion direction can be increased. Additionally, as shown in FIG. 5, the four outer edge portions 23 of the press fit portion 13 slightly push out portions of the inner surface 3*a*. Thus, the effective contact area of the press-fit pin 1 with the inner surface 3*a* is increased, thereby increasing frictional resistance. The increase in the effective contact area allows electrical contact resistance to be reduced, and the increase in the friction resistance prevents the press-fit pin 1 from falling away from the through-hole 3.

Figure 7:
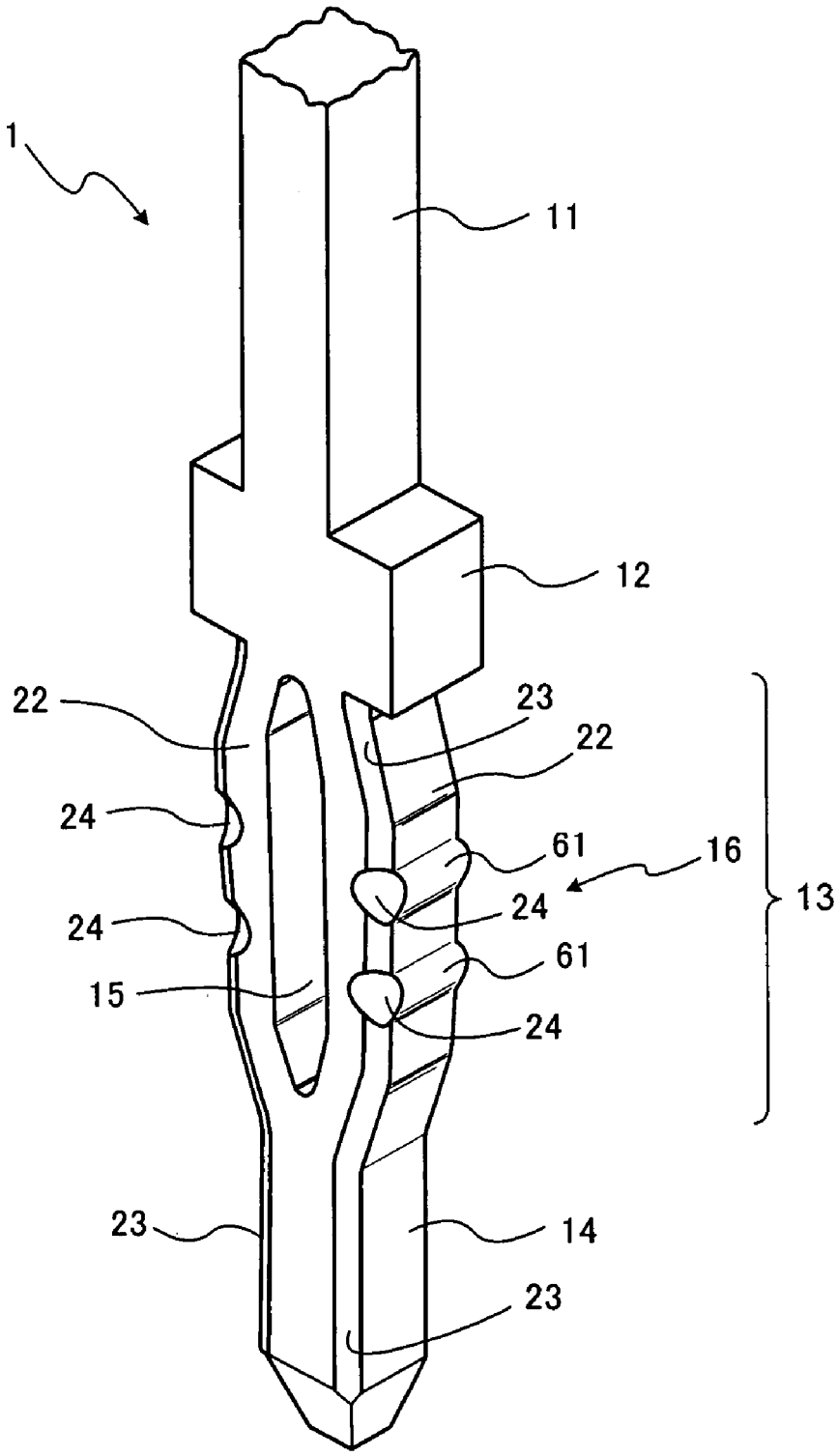
FIG. 7 shows a perspective view of a press-fit pin according to one embodiment of the invention.
Figure 8:
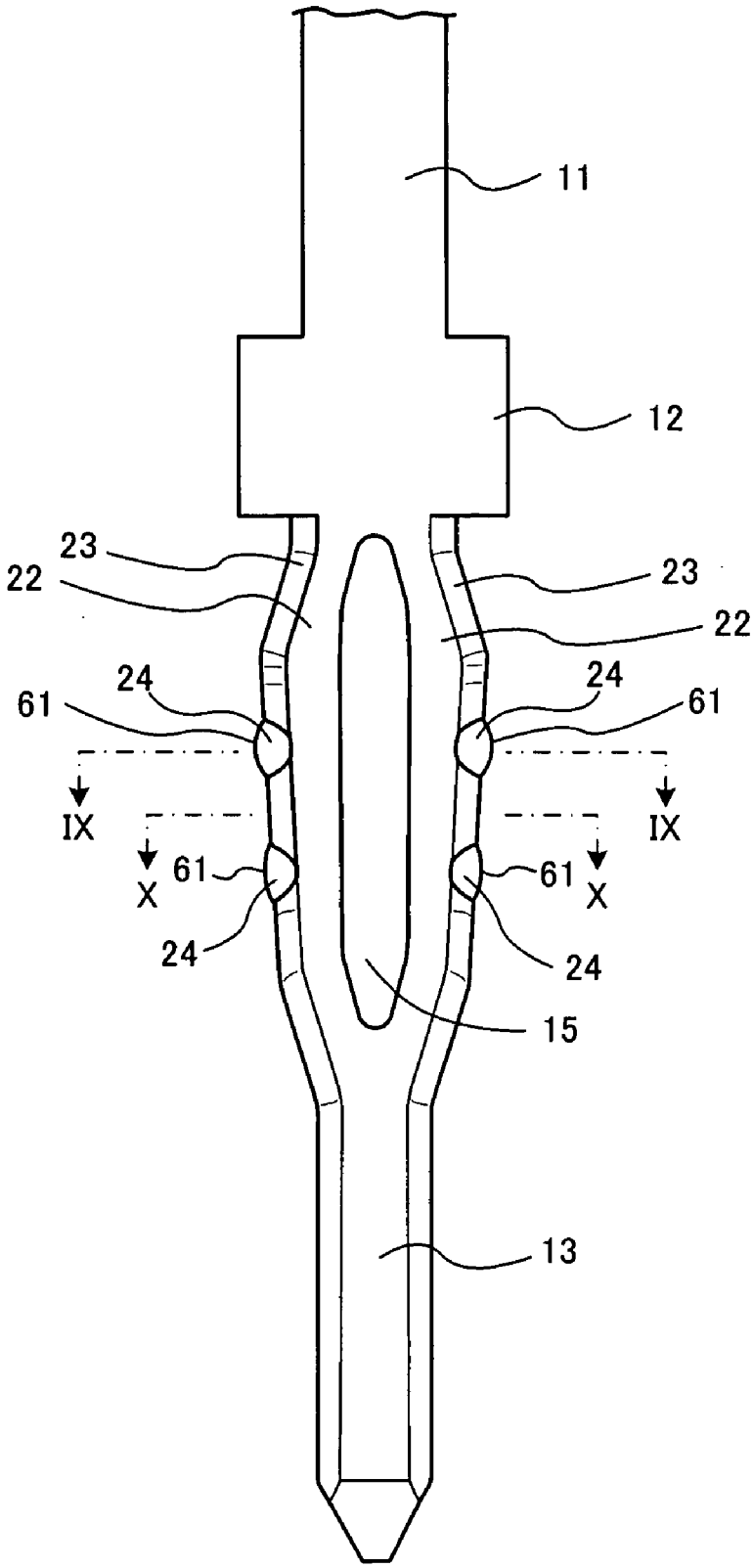
FIG. 8 shows a front view of a press-fit pin according to one embodiment of the invention.

FIGS. 7 and 8 show the press-fit pin according to an alternative embodiment of the invention. In this embodiment, an interference fit mechanism 16 designed on a surface of the press fit portion 13 includes the plurality of recesses 23 discussed above and a plurality of protrusions 61. As is apparent from FIGS. 7 and 8, the two protrusions 61 are formed each on two sides of the press fit portion 13. Further, the two recesses 24 are formed each on the four outer edge portions 23 of the press fit portion 13, abutting on the protrusions 61. Although this embodiment achieves the interference fit mechanism 16 by virtue of serration composed of the eight recesses 24 and the four protrusions 61, those of ordinary skill in the art will appreciate that this configuration may be modified without departing from the scope of the invention. For example, the interference fit mechanism 16 may be configured by at least one protrusion 61 on each side without disposing the recess 23. Alternatively, the recesses 23 and the protrusions 61 may be disposed at a predetermined distance.

Figure 9:
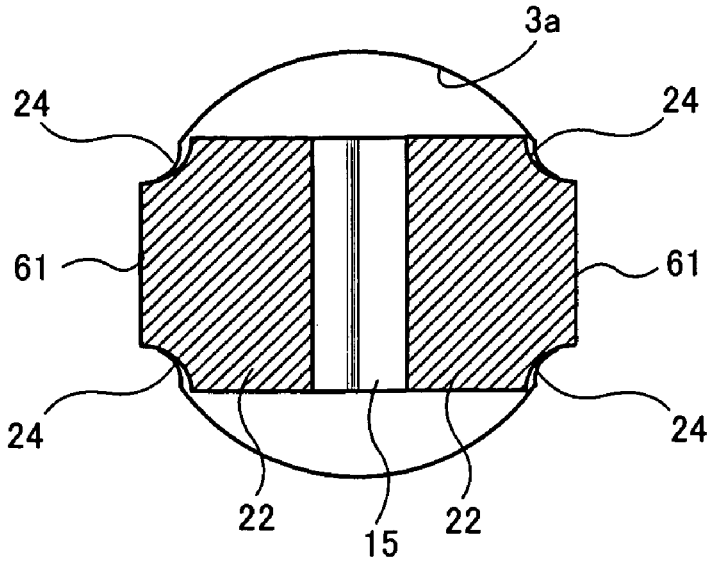
FIG. 9 shows a cross-sectional view of the press-fit pin along the IX-IX line according to one embodiment of the invention.
Figure 10:
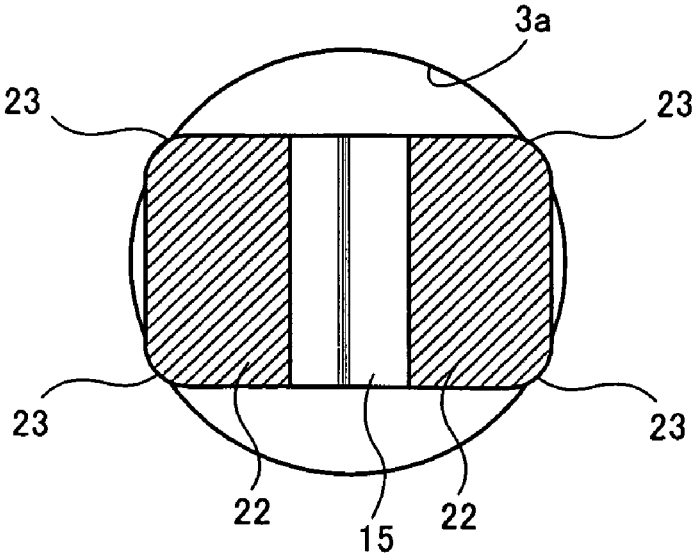
FIG. 10 shows a cross-sectional view of the press-fit pin along the X-X line according to one embodiment of the invention.
Figure 11:
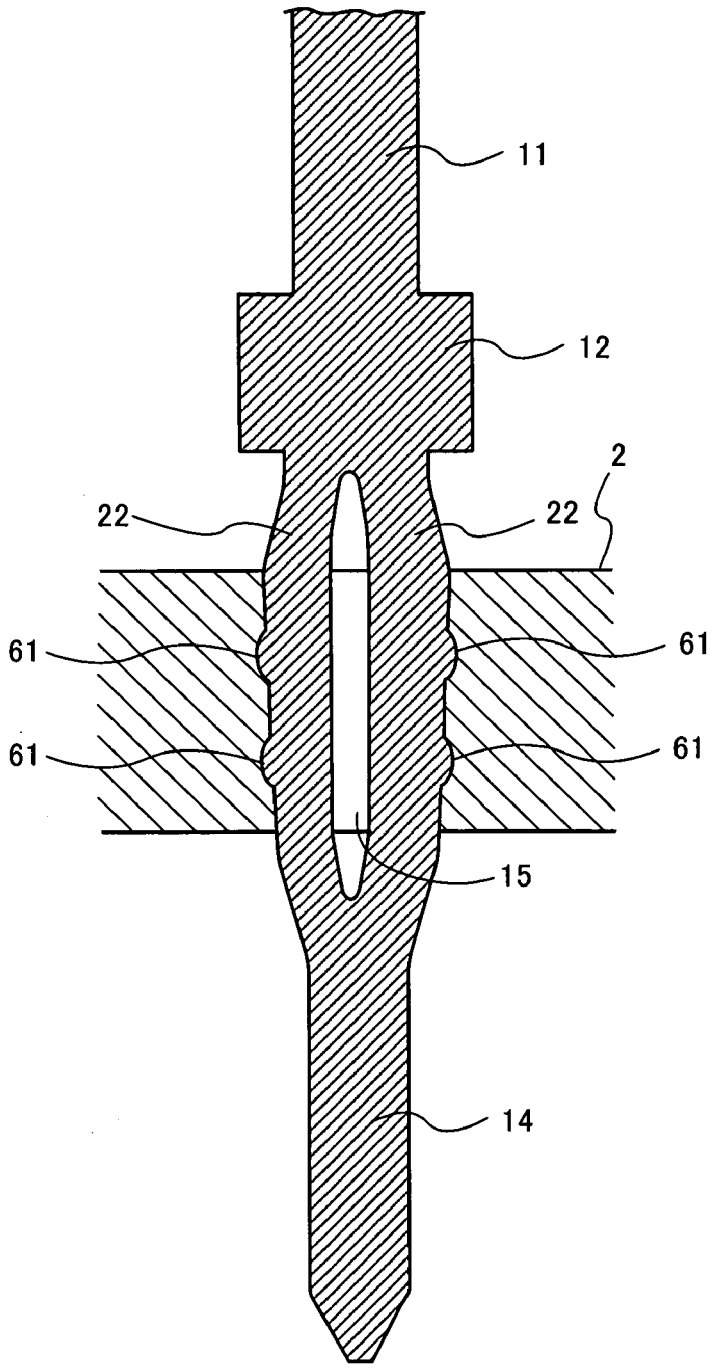
FIG. 11 shows a longitudinal cross-sectional view of the press-fit pin inserted into the present invention.

FIGS. 9 and 10 shows a transverse cross-sectional view of the press-fit pin 1 according to this embodiment, as the press-fit pin 1 is press-fitted into the through-hole 3. Specifically, FIG. 9 shows a cross-sectional view of the press-fit pin 1 along line IX-IX shown in FIG. 8 as including some of the recesses 24, and FIG. 10 shows a cross sectional view of the press-fit pin 1 along line X-X shown in FIG. 3. Further, FIG. 11 shows a longitudinal cross-sectional view of the press-fit pin 1 as the press-fit pin 1 is press-fitted into the through-hole 3.

As is apparent from these figures, press-fitting of the press-fit pin 1 causes the inner surface 3*a* to be deformed so as to engage with the interference fit mechanism 16 due to interference with the interference fit mechanism 16. More specifically, as shown in FIGS. 10 and 11, in a case where the press-fit pin 1 is press-fitted into the through-hole 3, the protrusions 61 intrude into the inner surface 3*a* of the through-hole 3. Further, portions of the inner surface 3*a* corresponding to the recesses 24 is restored because of regionally elastic recovery as discussed above, thereby fitting into the recesses 24. As a consequence, mechanical resistance to the insertion direction can be increased. Additionally, as shown in FIG. 10, the four outer edge portions 23 of the press fit portion 13 slightly push out corresponding portions of the inner surface 3*a* because of elastic recovery of the press fit portion 13 compressed. Thus, the interference fit mechanism 16 comprising the recesses 24 and the protrusions 61 allows the effective contact area of the press-fit pin 1 with the inner surface 3*a* to be increased, thereby increasing frictional resistance. The increase in the effective contact area allows electrical contact resistance to be reduced. Further, the recesses 24 and the protrusions 61 may tolerate margin errors between the press fit portion 13 and the through-hole 3.

Although some embodiments are explained as taking the needle-eye-type press-fit pin, other types, such as a U-shaped cross section or a Z-shaped cross section, press-fit pin may be applied.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A press-fit pin for mechanically and electrically connecting to a conductive through-hole of a substrate comprising:

a contact portion;

a press-fit portion connected to the contact portion and having a first arm portion and a second arm portion configured to define an eye extending along a longitudinal axis of the press-fit portion configured to be elastically deformed by interference with an inner surface of the conductive through-hole in a transverse direction substantially perpendicular to the longitudinal axis of the press-fit portion, further comprising:

at least one recess, wherein the recess is positioned on an outer corner of the press-fit portion and configured to make full surface contact, by elastic deformation and regional elastic recovery, with the inner surface of the through-hole; and a tip portion connected to the press-fit portion, wherein the press-fit portion comprises an interference fit mechanism.

2. The press-fit pin according to claim 1, wherein the interference fit mechanism comprises at least one projection disposed on a surface of the press-fit portion.

3. The press-fit pin according to claim 1, further comprising a shoulder portion disposed between the contact portion and the press-fit portion and configured to extend beyond the press-fit portion in the transverse direction.

4. The press-fit pin according to claim 1, wherein the press-fit portion is tapered toward the tip portion.

5. A method of forming a press-fit electrical connection, comprising:

forming a press-fit pin comprising:

a contact portion;

a press-fit portion connected to the contact portion, and having a first arm portion and a second arm portion configured to define an eye extending along a longitudinal axis of the press-fit portion, configured to be elastically deformed by interference with an inner surface of the conductive through-hole in a transverse direction substantially perpendicular to the longitudinal axis of the press-fit portion, further comprising:

at least one recess, wherein the recess is positioned on an outer corner of the press-fit portion and configured to make full surface contact, by elastic deformation and regional elastic recovery, with the inner surface of the through-hole; and a tip portion connected to the press-fit portion, wherein the press-fit portion comprises an interface fit mechanism; and inserting the press-fit pin in a through-hole of a substrate, thereby causing deformation of the press-fit pin.

6. The method according to claim 5, wherein the interference fit mechanism comprises at least one projection disposed on a surface of the press-fit portion.

* * * * *